United States Patent [19]

Roberts

[11] 4,360,179

[45] Nov. 23, 1982

[54] ARCHERY BOW STANDS

[76] Inventor: Theodore E. Roberts, 412 W. Main, Manchester, Mich. 48158

[21] Appl. No.: 164,834

[22] Filed: Jun. 30, 1980

[51] Int. Cl.[3] ..... A47G 29/00

[52] U.S. Cl. ..... 248/126; 124/23 R; 248/122; 248/309 R

[58] Field of Search ..... 248/126, 121, 122, 156, 248/176, 178, 165, 309 R, 274; 124/23 R, 1; 42/94

[56] References Cited

U.S. PATENT DOCUMENTS

| | | | |
|---|---|---|---|
| 2,275,870 | 3/1942 | Sheldon | 248/122 |
| 2,375,214 | 5/1945 | Creedon | 248/126 |
| 3,209,442 | 10/1965 | Watson | 124/23 X |
| 3,219,299 | 11/1965 | Snider et al. | 248/156 |
| 3,256,872 | 6/1966 | Koser | 248/463 X |
| 3,286,961 | 11/1966 | Mandolare | 248/126 X |
| 3,441,241 | 4/1969 | Brooks | 248/122 X |
| 3,584,820 | 6/1971 | Butcher | 42/94 |
| 3,991,780 | 11/1976 | Mroski | 248/122 |
| 4,215,838 | 8/1980 | Gullota | 248/167 X |

*Primary Examiner*—J. Franklin Foss

*Attorney, Agent, or Firm*—Olsen and Stephenson

[57] ABSTRACT

Bow stand apparatus for supporting an archery bow in an upright position, which includes receptacle means that can be adjusted in size to fit the bow, and leg means that can easily be connected to or adjusted relative to the receptacle means for supporting the apparatus on a variety of supporting surfaces, such as tree platforms, the ground, indoor floor surfaces and the like.

8 Claims, 9 Drawing Figures

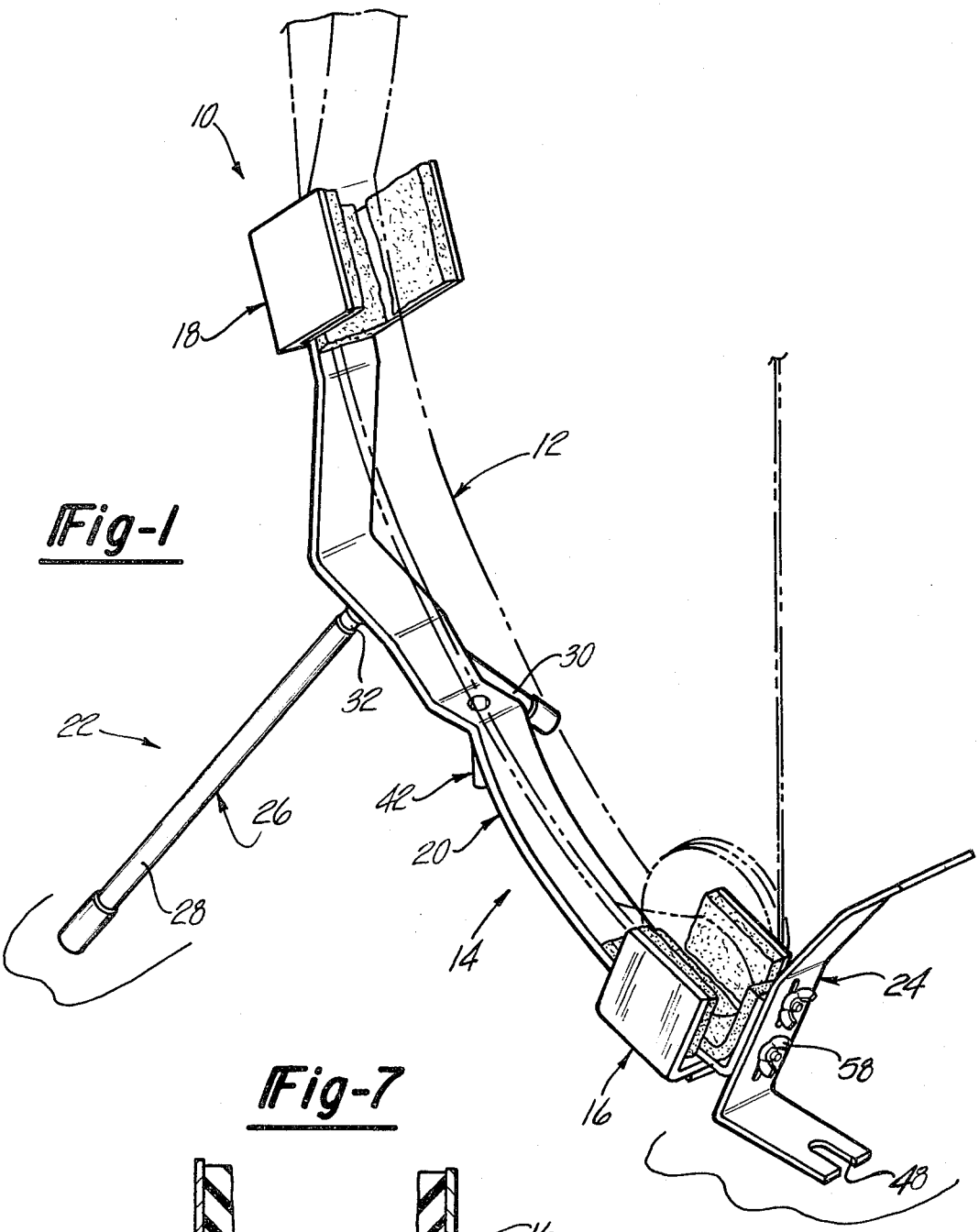
Fig-1
Fig-7
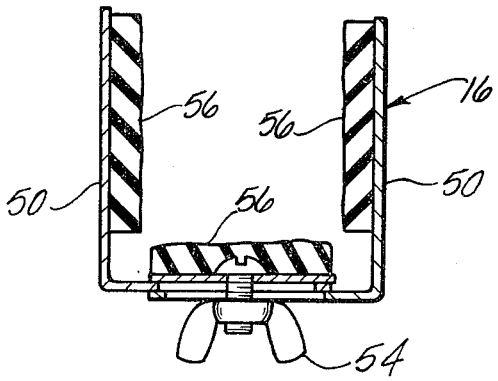

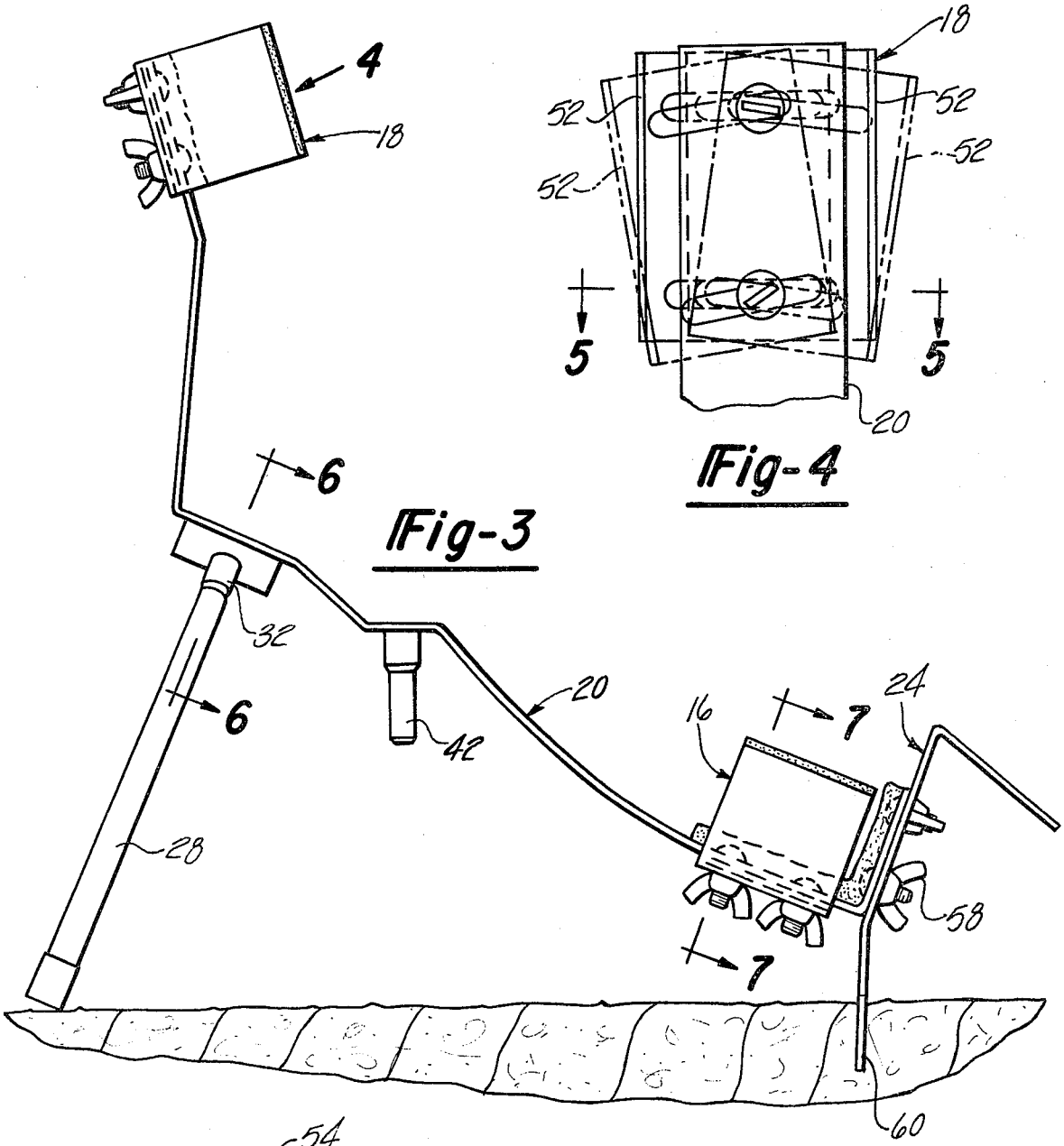
Fig-3
Fig-4
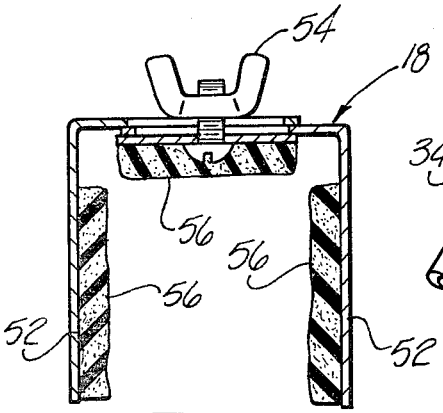
Fig-5
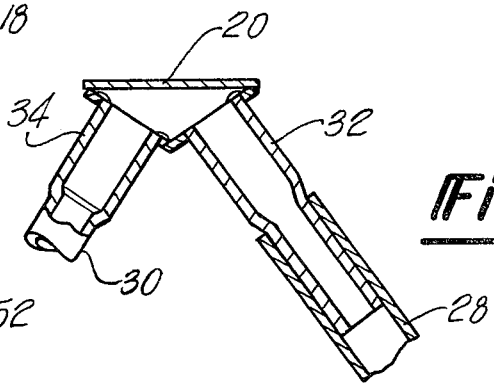
Fig-6

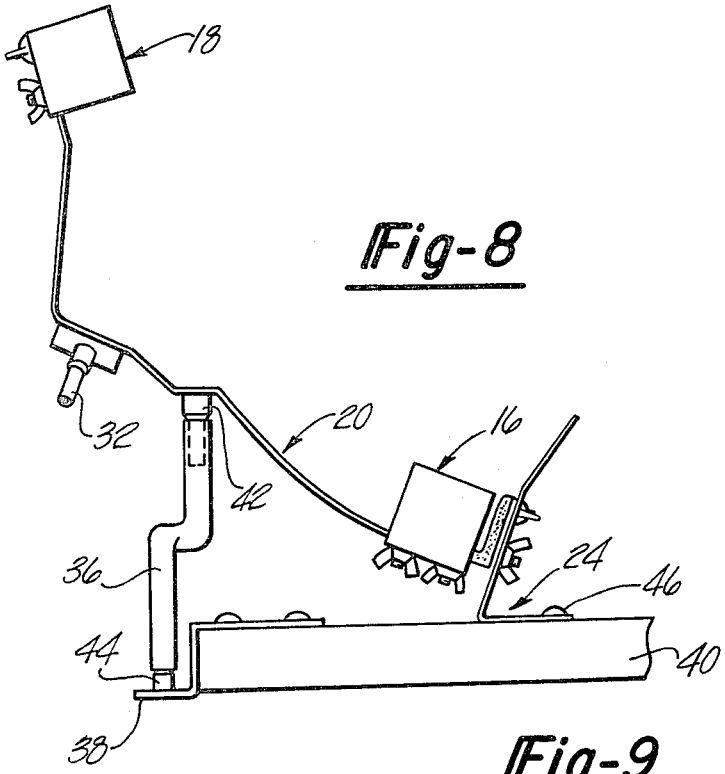
Fig-8
Fig-9
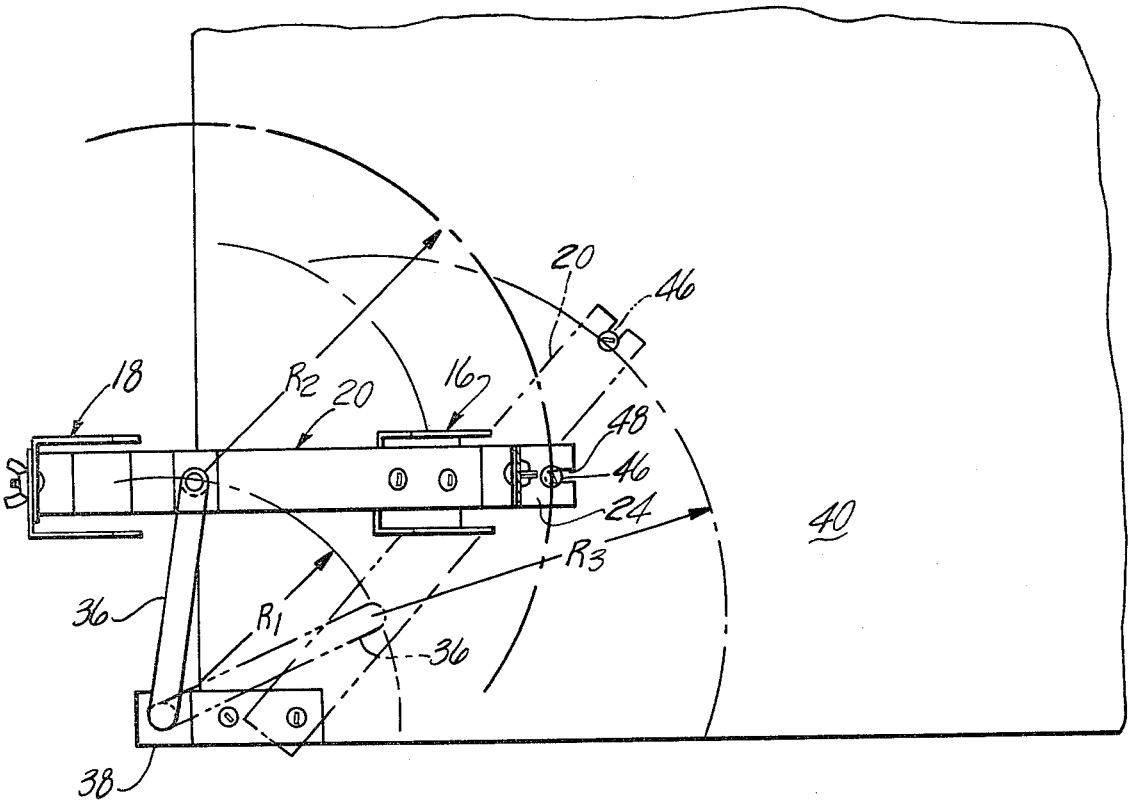

ARCHERY BOW STANDS

TECHNICAL FIELD

The present invention relates to stands for archery bows, and particularly to such stands for supporting an archery bow in an upright position at various sites of use, such as in a tree, on the ground or at an archery range.

BACKGROUND ART

It is known in the art to provide a bow-stand for supporting a bow in an upright position. Representative U.S. patents which disclose conventional bow stands or holders are:

U.S. Pat. No. 3,219,299; Snider et al; Nov. 23, 1965
U.S. Pat. No. 3,256,872; Koser; June 21, 1966
U.S. Pat. No. 3,286,961; Mandolare; Nov. 22, 1966
U.S. Pat. No. 3,441,241; Brooks; Apr. 29, 1969
U.S. Pat. No. 3,584,820; Butcher, Sr.; June 15, 1971

Conventional bow stands of the types disclosed in these patents leave much to be desired. Initially, they are designed primarily to support earlier styles of bows and are not particularly well suited to support compound bows. Further, these conventional bow stands have very limited versatility, are often difficult and cumbersome to transport, and are not easily assembled and disassembled. Thus, they cannot be used satisfactorily when it is desired to hunt from a location such as in a tree, for example, because the conventional bow stands cannot always be mounted on a hunter's tree support so as to enable the hunter to align the bow properly and simultaneously to enable the hunter to remain in a comfortable position on his perch and in readiness should game appear in the expected target area.

SUMMARY OF THE INVENTION

The present invention has overcome the inadequacies of the prior art, and provides an improved bow stand that is constructed and arranged so that it has a broad range of uses, such as for display, for archery range activities, for hunting, either from a location on the ground or from a perch in a tree, and the like. The invention is especially adapted for hunting purposes so that the hunter can maintain in comfort a position of rediness and can then use the bow noiselessly and with a minimum of movement when game appears. In a preferred form, the invention is particularly adapted for use with a compound archer bow.

According to one form of the present invention, a stand for an archery bow is provided comprising a frame assembly having receptacle means for receiving and supporting a bow in an upright position, a leg assembly connected to the frame assembly for supporting the frame assembly in selected positions on a supporting surface and so that a bow supported in the receptacle means will be generally upright, either the leg assembly or the frame assembly providing a rear leg means for engagement with the supporting surface, and the leg assembly has forward leg means connected at the upper end to a midportion of the frame assembly and having a lower end for engagement with the supporting surface.

The forward leg means is connected at its upper end to said frame assembly by a first swivel connection and at its lower end to the supporting surface by a second swivel connection, the swivel connections having vertical axes out of alignment with each other so that the upper swivel connection can be rotated in a circle around the lower swivel connection for positioning the stand. Preferably, the rear leg means has an attachment means for fastening to the supporting surface after the forward leg means has been utilized for movement to a desired position. This form of leg means is especially adapted for use when a tree stand for hunting purposes is desired. The first swivel to which the forward leg means is fastened can then be mounted on a conventional tree platform on which the hunter will be perched, and a plurality of fastening elements can be located on the surface of the platform to which the rear leg means can be selectively fastened. Preferably, the leg means will be in the form of a crank for selectively aligning the stand before the rear leg means is fastened.

An interchangeable second set of forward leg means is provided for use in place of the forward leg means used in the tree stand. The second set includes a pair of leg members adapted to be rigidly connected to the frame assembly and to form with the rear leg means a tripod—like structure for supporting the stand on the ground or other supporting surface. For this purpose the rear leg means may be an invertable bracket which has a spike at one end for insertion into the ground.

It is also preferred that the receptacle means be adjustable in size to be fitted to the dimensions of the bow. This is an especially desirable feature when the stand is to be used with a compound bow. Also, foamed elastomeric material is used as a liner for the receptacles to protect the bow from abrasion and also during hunting to permit the hunter to lift the bow noiselessly when game has been sighted.

Other objects of this invention will appear in the following description and appended claims, reference being had to the accompanying drawings forming a part of this specification wherein like reference characters designate corresponding parts in the several views.

BRIEF DESCRIPTION OF THE DRAWINGS

FIG. 1 is a fragmentary perspective view of a stand embodying one form of the present invention and assembled for mounting on a flat surface, and showing in broken lines a compound archery bow supported in an upright position;

FIG. 3 is a side elevational view of the embodiment of FIG. 1, but showing the rear leg means inverted so that a spike penetrates the ground;

FIG. 4 is an enlarged fragmentary view as seen in the direction of the arrow 4 in FIG. 3;

FIG. 5 is a sectional view taken on the lines 5—5 of FIG. 4;

FIG. 6 is a sectional view taken on the lines 6—6 of FIG. 3;

FIG. 7 is a sectional view taken on the lines 7—7 of FIG. 3;

FIG. 8 is a fragmentary side elevational view of the stand assembled for mounting on a tree platform; and FIG. 9 is a fragmentary top plan view of the stand shown in FIG. 8, and showing in broken lines another position to which the stand can be moved.

DESCRIPTION OF THE PREFERRED EMBODIMENT

Figure 2:
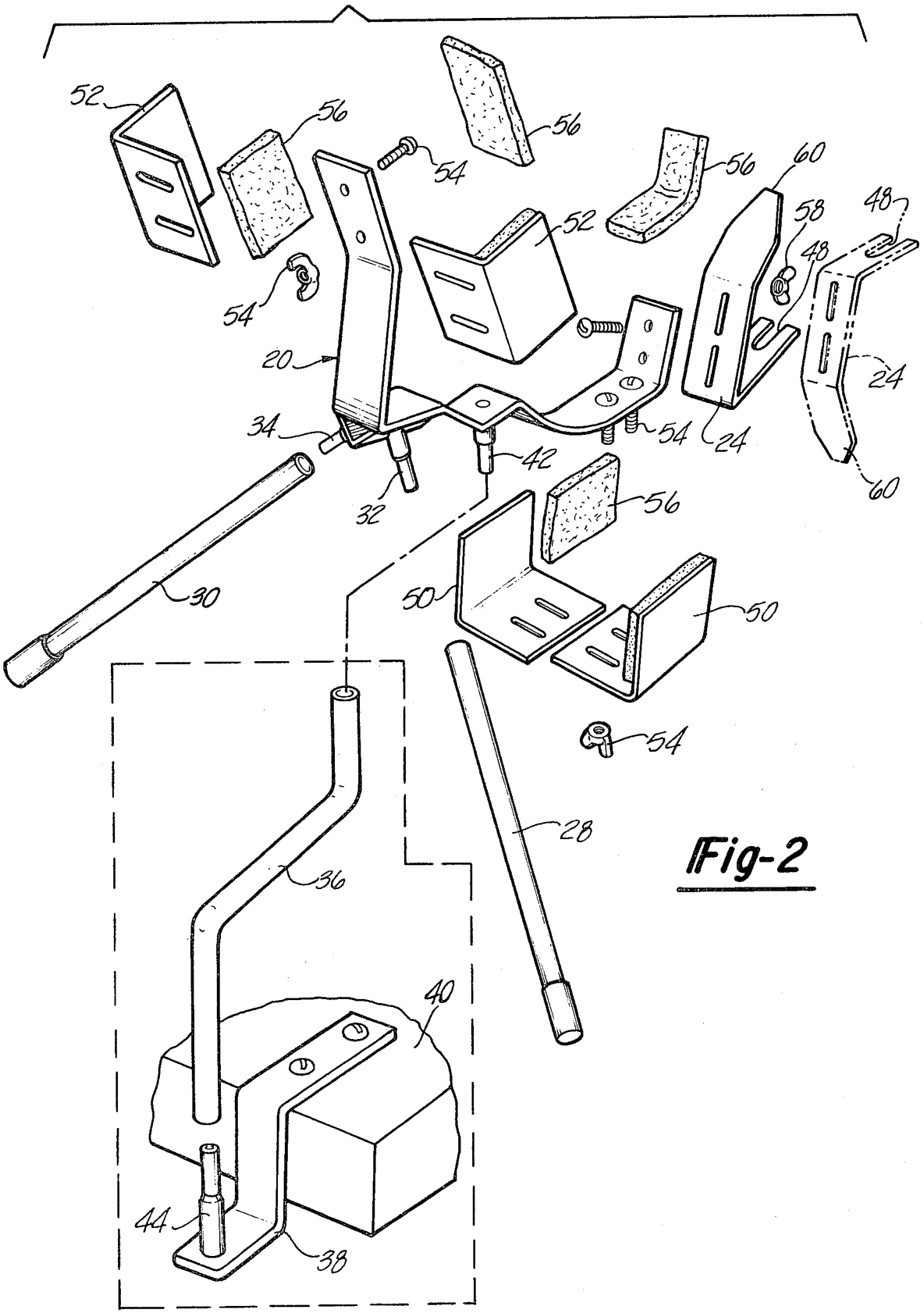
FIG. 2 is an exploded view of the stand and illustrating a second forward leg means that can be used interchangeably with the forward leg means shown in FIG. 1.

Before explaining the present invention in detail, it is to be understood that the invention is not limited in its application to the details of construction and arrangement of parts illustrated in the accompanying drawings, since the invention is capable of other embodiments and of being practiced or carried out in various ways. Also, it is to be understood that the phraseology or terminology employed herein is for the purpose of description and not of limitation.

Referring now to the drawings, the archery bow stand 10 will be described in greater detail. Positioned in the stand 10 in an upright position is a compound archery bow 12 which will not be described further, because it is conventional in construction and is not a part of the present invention.

The bow stand 10 includes the frame assembly 14 comprising the lower receptacle 16 for receiving the lower end of the bow 12, the upper receptacle 18 for receiving an intermediate segment of the bow 12, and an arm 20 connected to the lower and upper receptacles 16 and 18 for holding the receptacles in fixed positions relative to one another; and the leg assembly 22 releasably connected to the frame assembly 14 and comprising the rear leg menas or bracket 24, and forward leg means 26. The forward leg means 26 can be in two sets, one set including the two leg members 28 and 30 which can be manually pressed onto the angularly disposed posts 32 and 34 located on a mid-portion of the arm 20 so that together with arm 20 and the rear leg means or bracket 24 they form a tripod-like structure for supporting the frame assembly 14 in selected positions on the ground or other supporting surface with the archery bow 12 in an upright position.

The second set of forward leg means that are interchangeable with the leg members 28 and 30 include the crank 36 and the base member 38. The latter is adapted to be mounted on a rigid support surface or platform 40 as shown in FIGS. 2 and 8. The upper end of crank 36 can be manually pressed onto the post 42 that is located at a mid-portion of the arm 20, and the lower end of crank 36 can be manually pressed on the post 44 of base member 38 so that swivel connections are provided at the upper and lower ends of the crank 36. The swivel connections have vertical axes that are out of axial alignment so that the mid-portion of arm 20 at the post 42 can be rotated in a horizontal circle defined by the radius $R_1$, as seen in FIG. 9. The arm 20 can also be rotated around the axis of post 42 so that the rear leg means or bracket 24 can be rotated around in a second circle defined by the radii $R_2$ or $R_3$, thus enabling the frame assembly 14 to be aligned in an infinite number of positions. To secure the frame assembly 14 in any selected position a fastener or screw 46 can be secured to the platform 40. The one end of the bracked or rear leg means 24 in which the slot 48 exists can then be thrust under the head of the fastener 46 and the bow stand 10 will be retained in a selected position such as is shown, for example, in solid lines in FIGS. 8 and 9.

As seen in FIGS. 5 and 7, the receptacles 16 and 18 have side walls 50 and 52, respectively, which are laterally displaceable with respect to one another to vary the interior widths of the receptacles. Thumb nuts and screw assemblies 54 are provided to secure the side walls in desired positions that are best suited to accommodate the compound bow 12. Also, the interiors of the receptacles 16 and 18 are lined with a suitable foamed elastomeric material 56. As seen in FIG. 4, the side walls 52 can be moved either laterally or in divergent alignment to accommodate the shape or contour of the compound bow. The cushioning effect of the elastomeric material 56 serves to protect the bow from abrasions and also enables the hunter to lift the bow quietly when game enters the target area.

The arm 20 is preferably formed from a strap of metal so that it can define a shape generally conforming to the shape of the lower contour of the archery bow 12, and the posts 32 and 34 can be secured to the arm 20 at desired diverging angles by mounting the posts 32 and 34 in the manner illustrated in FIG. 6. Similarly, post 42 which is normally in a vertical position can be welded or otherwise secured to a horizontal segment of the arm 20, as seen in FIG. 3.

The rear leg means or bracket 24 is releasably secured to the lower receptacle 16 by conventional thumb nuts and screw assemblies, as shown at 58, so as to allow the spike 60 to be positioned lowermost when the stand 10 is to be erected on the ground, as shown in FIG. 3, or so that the rear leg means or bracket 24 can be inverted to allow the other end which has the slot 48 to be lowermost for support on the platform 40, as shown in FIG. 8. The rear leg means or bracket 24 is also vertically adjustable on the lower receptacle 16 to facilitate fitting the bow stand 10 to the platform 40.

From the foregoing description, it is to be recognized that the bow stand 10 can be used readily in various locations, such as on tree platforms, on the ground, or for a variety of uses, such as for display purposes, archery practice, or the like. The frame assembly 14 and leg assembly 22 can be easily assembled or disassembled, and it can be transported conveniently by the hunter in several suitable ways. For example, the entire assembly can be secured together by an elastic rope and carried on the belt of the hunter by a belt clip.

It is claimed :

1. A stand for an archery bow comprising a frame assembly having receptacle means for receiving and supporting a bow in an upright position, and a leg assembly connected to the frame assembly for supporting the frame assembly in selectedpositions on a supporting surface and so that a bow supported in the receptacle means will be generally upright, characterized in that one of said leg and said frame assemblies includes a rear leg means for engagement with said supporting surface, and said leg assembly has forward leg means with an upper end thereof connected to a mid-portion of said frame assembly and a lower end thereof for engagement with said supporting surface and in that said forward leg means is connected at its upper end to said frame assembly by a first swivel connection and at its lower end to said supporting surface by a second swivel connection, said first and second swivel connections having vertical axes out of vertical alignment with each other so that the upper swivel connection can be rotated in a circle around said lower swivel connection for positioning purposes.

2. A stand for an archery bow such as is defined in claim 1, characterized in that said rear leg means includes an attachment mechanism for fastening to the supporting surface when said forward leg means is in a desired position.

3. A stand for an archery bow comprising a frame assembly and a leg assembly, characterized in that said frame assembly has a lower receptacle for receiving the lower end of an upright bow, an upper receptacle for receiving an intermediate segment of the upright bow, and an arm connected to the lower and upper receptacles for holding the receptacles in fixed positions relative to one another; and said leg assembly is releasably connected to the frame assembly for supporting the frame assembly in selected positions on a supporting surface and so that a bow supported in the receptacle will be generally upright, said leg assembly having a rear bracket connected to said lower receptacle and an end for engagement with said supporting surface, and a forward leg means with an upper end thereof connected to a mid-portion of said arm and a lower end thereof for engagement with said supporting surface; further characterized in that said forward leg means includes a base member for connection to said supporting surface, said base member having a first swivel connection, said mid-portion of said arm having a second swivel connection, both such swivel connections having vertical axes, and a crank arm connected to said swivel connections for swivel movement of said frame assembly about either of said vertical axes, said rear bracket having fastening means for attachment to the supporting surface at selected positions of swivel movement of said frame assembly.

4. A stand for an archery bow such as is defined in claim 3, characterized in that said rear bracket is removably connected to said lower receptacle, said rear bracket having a spike extending from one end and a bolt fastener extending from the other end and arranged so that the bracket can be connected in an upright or an inverted position to said lower receptacle so as to provide either the spike or the bolt fastener for engagement with said supporting surface.

5. A stand for an archery bow comprising a frame assembly and a leg assembly, characterized in that said frame assembly has a lower receptacle for receiving the lower end of an upright bow, an upper receptacle for receiving an intermediate segment of the upright bow, and an arm connected to the lower and upper receptacles for holding the receptacles in fixed positions relative to one another; and said leg assembly is releasably connected to the frame assembly for supporting the frame assembly in selected positions on a supporting surface and so that a bow supported in the receptacles will be generally upright, said leg assembly having a rear bracket connected to said lower receptacle and an end for engagement with said supporting surface, and a forward leg means with an upper end thereof connected to a mid-portion of said arm and a lower end thereof for engagement with said supporting surface; further characterized in that said rear bracket is connected to said lower receptacle by adjustable means to permit vertical adjustment of the rear bracket relative to the lower receptacle.

6. A stand for an archery bow comprising a frame assembly and a leg assembly, characterized in that said frame assembly has a lower receptacle for receiving the lower end of an upright bow, an upper receptacle for receiving an intermediate segment of the upright bow, and an arm connected to the lower and upper receptacles for holding the receptacles in fixed positions relative to one another; and said leg asembly is releasably connected to the frame assembly for supporting the frame assembly in selected positions on a supporting surface and so that a bow supported in the receptacles will be generally upright, said leg assembly having a rear bracket connected to said lower receptacle and an end for engagement with said supporting surface, and a forward leg means with an upper end thereof connected to a mid-portion of said arm and a lower end thereof for engagement with said supporting surface; further characterized in that said arm is a strap of generally arcuate shape to conform to the shape of a compound bow, said receptacles projecting inwardly from the opposite ends of the arcuate strap, and said strap has a plurality of mounting posts projecting downwardly at said mid-portion of said arm for mounting on said forward leg means.

7. A stand for an archery bow comprising a frame assembly and a leg assembly, characterized in that said frame assembly has a lower receptacle for receiving the lower end of an upright bow, an upper receptacle for receiving an intermediate segment of the upright bow, and an arm connected to the lower and upper receptacles for holding the receptacles in fixed positions relative to one another; and said leg assembly is releasably connected to the frame assembly for supporting the frame assembly in selected positions on a supporting surface and so that a bow supported in the receptacles will be generally upright, said leg assembly having a rear bracket connected to said lower receptacle and an end for engagement with said supporting surface, and two sets of interchangeable forward leg means each with an upper end thereof for connection to a mid-portion of said arm and a lower end thereof for engagement with said supporting surface, the first set including a base member for connection to said supporting surface, said base member having a first swivel connection, said mid-portion of said arm having a second swivel connection, both said swivel connections having vertical axes, and a crank arm for connection to said swivel connections for swivel movement of said frame assembly about either of said vertical axes, said rear bracket having fastening means for attachment to the supporting surface at selected positions of swivel movement of said frame assembly, and the second set including two leg members, each leg member being adapted to be releasably connected to said mid-portion of said arm, the two leg members and said rear bracket being arranged with said arm for supporting the frame assembly on said supporting surface.

8. A stand for an archery bow comprising a frame assembly and a leg assembly, characterized in that said frame assembly has a lower receptacle for receiving the lower end of an upright bow, an upper receptacle for receiving an intermediate segment of the upright bow, and an arm connected to the lower and upper receptacles for holding the receptacles in fixed positions relative to one another; and said leg assembly is releasably connected to the frame assembly for supporting the frame assembly in selected positions on a supporting surface and so that a bow supported in the receptacles will be generally upright, said leg assembly having a rear leg bracket at the lower end of said arm for engagement with said supporting surface, and a forward leg means with an upper end thereof connected to a mid-portion of said arm and a lower end thereof for engagement with said supporting surface; further characterized in that said rear leg bracket is removably connected to the lower end of said arm, said rear leg bracket having a spike extending from one end and a fastening means from the other end and arranged so that the bracket can be connected in an upright or inverted position to the lower end of said arm so as to provide either the spike or the fastening means for engagement with said supporting surface.

* * * * *